US005570660A

United States Patent [19]

Vandenberg

[11] Patent Number: 5,570,660

[45] Date of Patent: Nov. 5, 1996

[54] AUTOMATED SLUDGE LANCE

[75] Inventor: James P. Vandenberg, Cambridge, Canada

[73] Assignee: The Babcock & Wilcox Company, New Orleans, La.

[21] Appl. No.: 392,651

[22] Filed: Feb. 23, 1995

Related U.S. Application Data

[62] Division of Ser. No. 189,619, Feb. 1, 1994, abandoned.

[51] Int. Cl.[6] ..... F22B 37/18

[52] U.S. Cl. ..... 122/379; 122/382; 122/390; 122/392; 165/95

[58] Field of Search ..... 122/379, 382, 122/390, 392; 165/95

[56] References Cited

U.S. PATENT DOCUMENTS 4,492,187 1/1985 Hammond ..... 122/390
5,067,588 11/1991 Boisture ..... 165/95
5,320,073 6/1994 Silcott et al. ..... 122/392
5,341,406 8/1994 Jens et al. ..... 376/316

*Primary Examiner*—Henry A. Bennett
*Assistant Examiner*—Siddharth Ohri
*Attorney, Agent, or Firm*—Daniel S. Kalka; Robert J. Edwards

[57] ABSTRACT

An automated sludge lance and method is described for cleaning sludge from tubes in a steam generator. The lance guide and waterlance are moved inside the steam generator to direct a fluid between the tubes to effectively clean sludge from the tubes. The remote control system is mounted outside the steam generator where it is readily serviceable. The automated sludge lance and method can be used in the no-tube-lane, in the annular chamber, or in combination.

5 Claims, 5 Drawing Sheets

AUTOMATED SLUDGE LANCE

This is a divisional of U.S. patent application Ser. No. 08/189,619 filed Feb. 1, 1994, now abandoned.

BACKGROUND OF THE INVENTION

1. Field of the Invention

The present invention relates, in general, to equipment for cleaning steam generators and, in particular to an automatic sludge lance and method for cleaning sludge from steam generator tubes of a steam generator.

2. Description of the Related Art

In nuclear power stations, steam generators, such as recirculating steam generators and once-through steam generators, are used for heat exchange purposes in the generation of steam to drive the turbines. Primary fluid which is heated by the core of the nuclear reactor passes through a bundle of tubes in the steam generator. Secondary fluid, normally water, which is fed into the space surrounding the tubes, receives heat from the tubes and is converted into steam for driving the turbines. After cooling and condensation has occurred, the secondary fluid is directed back into the space around the tubes to provide a continuous steam generation cycle. Due to the constant high temperature and severe operating conditions, sludge accumulates on the lower portions of the tubes and on the tubesheet which supports same. The sludge which is mainly comprised of an iron oxide, such as magnetite, reduces the heat transfer efficiency of the tubes and can cause corrosion. Thus, the tubes must be cleaned periodically to remove the sludge. Various types of apparatus and method are available to accomplish this task.

U.S. Pat. No. 4,566,406 entitled "Sludge Removing Apparatus for a Steam Generator" discloses a manifold which is rigidly attached to the tubesheet and remain in place during conventional operation of the steam on the upper surface of the tubesheet. Openings are provided in the walls of the steam generator to remove the slurry.

U.S. Pat. No. 4,079,701 entitled "Steam Generator Sludge Removal System" discloses an arrangement of headers at the elevation of the sludge to be removed from around the tubes in order to establish a circumferential fluid stream at the elevation. A fluid lance moved along a line between the headers emits a fluid jet perpendicular to the line of movement of the fluid lance. The lance may also be rotated as it is removed.

U.S. Pat. No. 4,700,662 entitled "Sludge Lance Wand" discloses a lance for cleaning once-through steam generator tubes. The lance has a fixed radius of curvature thus necessitating manual manipulation of same in order to insert the lance between tubes within the tube bundle in the steam generator.

U.S. Pat. No. 4,980,120 entitled "Articulated Sludge Lance" assigned to the assignee of the present invention discloses an articulated lance for cleaning sludge located between steam generator tubes. In operation, the lance is inserted through a handhole into a lane or space between tubes in a tube bundle.

U.S. Pat. No. 5,194,217 entitled "Articulated Sludge Lance with a Movable Extension Nozzle" is also assigned to the assignee of the present invention and discloses an articulated sludge lance with a retractable movable extension nozzle.

In addition, U.S. Pat. No. 4,980,120 in the background art section describes various techniques found in U.S. Pat. Nos. 4,556,406, 4,079,701 and 4,700,662.

In addition to those references, U.S. Pat. No. 4,407,236 to Schukei, et al discloses a thin strip of spring steel which enters a tube lane for sludge lance cleaning for nuclear steam generators. The forward ends of the capillary tubes are directed downward for the jetting fluid under high pressure.

U.S. Pat. No. 4,827,953 to Lee is directed to an automated flexible lance for steam generator secondary side sludge removal. This patent discloses a flexible lance having a plurality of hollow flexible tubes extending lengthwise along the flexible member and remotely controlled inside the steam generator. There are a plurality of nozzles at an end of the flexible members with the flexible member being configured to go into the difficult to access geometry of the steam generator.

U.S. Pat. No. 5,065,703 to Lee describes improvements to the aforementioned automated flexible lance for steam generators.

U.S. patent application Ser. No. 08/126,453 filed is Sep. 24, 1993 describes an articulated annular sludge lance.

Thus, there is still a need for a remote controlled automated sludge lancing method and apparatus which would position and manipulate the sludge lance in the steam generator and still have the drive assembly located outside the steam generator for easy accessibility. This would make the drive assembly readily serviceable and eliminate concerns of the harsh environment and space restrictions. Also, any loose parts would not damage the steam generator by being left inside. It is desirable for the apparatus and method to work from the no-tube lane and/or the annular chamber of the steam generator to provide the largest cleaning area possible.

SUMMARY OF THE INVENTION

The present invention solves the aforementioned problems associated with the prior art as well as others by providing an automated sludge lance and method for cleaning a steam generator.

The method of the present invention removes sludge located between the plurality of tubes within the steam generator by remotely positioning the lance guide and waterlance with a drive assembly located outside the steam generator and attached to the mounting flange of the steam generator. The lance guide is positioned at a preselected location in the steam generator and then the waterlance which is movably held therein is advanced between the tubes for cleaning.

The lance of the present invention removes sludge located between tubes of the tube bundle in a steam generator using lance guide which is manipulated from outside the steam generator with a drive assembly. The lance guide holds the waterlance which is moved in concert therewith and separately therefrom for cleaning the tubes.

Accordingly, an object of the present invention is to provide an automated sludge lance which cleans the tubes in a steam generator.

Another object of the present invention is to provide an automated method for cleaning a steam generator.

A further object of the present invention is to provide a remote control system for a sludge lance.

Still a further object of the present invention is to provide an automated sludge lance which is simple in design, rugged in construction, and economical to manufacture.

The various features of novelty characterizing the invention are pointed out with particularity in the claims annexed to and forming a part of this disclosure. For a better understanding of the invention, the operating advantages attained by its uses, reference is made to the accompanying drawings and descriptive matter in which a preferred embodiment of the invention is illustrated.

DESCRIPTION OF THE PREFERRED EMBODIMENT

Figure 1:
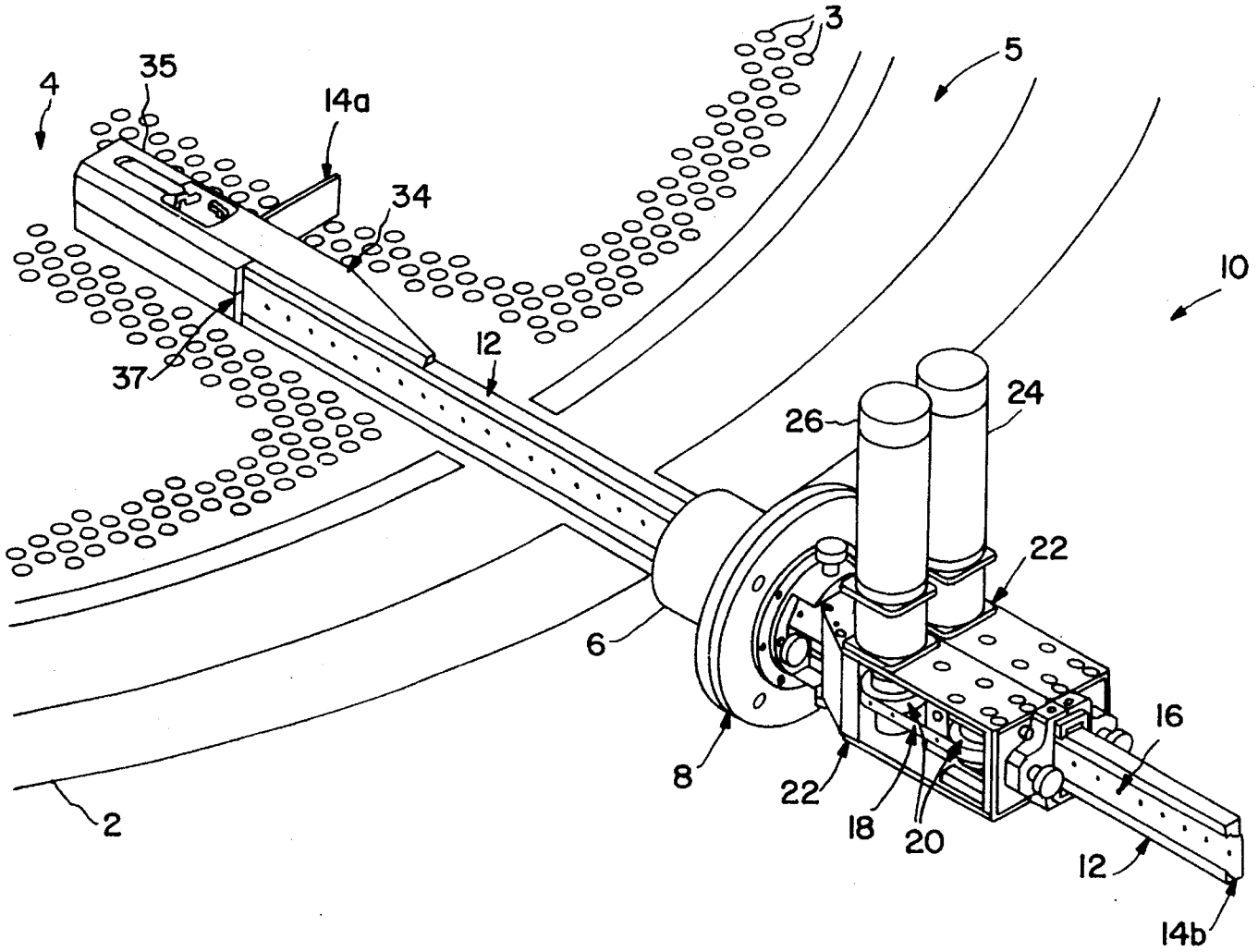
FIG. 1 is a perspective view of the present invention illustrating the waterlance in position in a steam generator with portions of the steam generator removed.

Referring to the figures generally, where like numerals designate like or similar features throughout the several drawings, and first to FIG. 1 in particular, there is shown an automated sludge lance generally designated (10) according to the present invention. The automated sludge lance (10) is attached with a mounting bracket (8) to a handhole or inspection port (6) in this embodiment to the no-tube-lane (4) of a steam generator (2). The automated sludge lance (10) includes a lance guide (12) a waterlance (14) movably situated therein and drive assembly (22) manipulating both the lance guide (12) and waterlance (14). The lance guide (12) and waterlance (14) are moved in the no-tube lane (4) of the steam generator to a selected position between tubes (3). A proximity sensor (35) attached to the lance guide head (34) initially identifies the location of the tubes and the intertube lane therebetween is then determined. At that point the waterlance (14) is advanced in the intertube lane between tubes (3) for removing sludge therefrom by injecting fluid such as water at a high pressure between the tubes (3). A similar manner of removing sludge is described in U.S. Pat. Nos. 4,980,120 and 5,194,127. The term "waterlance" as used herein is meant to include any fluid delivered under high pressure from the lance (14).

The lance guide (12) is basically a channel that is somewhat U-shaped and constructed to receive the waterlance (14). It may be constructed of a metal such as aluminum or a plastic like Delrin or polypropylene. Waterlance (14) preferably includes a stainless steel front and rear manifold, at least one fiber wrapped pressure tube preferably a plurality, and a single piece fiber reinforced cast polymer such as a polyurethane matrix body. Waterlance (14) may be constructed similar to the fluid distribution member described in U.S. Pat. Nos. 4,980,120 and 5,194,127.

A single row of integral holes (16) are placed preferably down the centerline of the lance guide (12) and waterlance (14) for positive engagement with a remote operated tractor drive assembly (22). In the preferred embodiment, the tractor drive assembly (22) includes a pinned belt (18) driven by pulley (20). The pinned belt (18) is preferably a flexible metal belt and pulleys (20) are stainless steel wheels without a groove.

With this arrangement, high traction is achieved by engaging several holes (16) at once, and the flow path in the waterlance (14) is not compromised as a maximum number of pressure tubes can still be incorporated in the design. The waterlance flow path starts at the rear manifold (**14*b*) where water is filtered and distributed to several pressure tubes. The pressure tubes transport the water through the waterlance body to the front manifold (14*a*) where the water is recombined in a single reservoir for transfer to the water jetting nozzles. U.S. Pat. Nos. 4,980,120 and 5,194,127 which are hereby incorporated by reference describe a fluid distribution member suitable as a waterlance in the present invention. While the jets may be arranged on the front end of the waterlance in a variety of ways, preferably there are two symmetrically opposed jets set at 90° to the waterlance so that one points straight up and the other straight down. A remote control drive assembly (22) is mounted to the inspection port (6) and drives the lance guide (12) and waterlance (14) along the no-tube-lane of the steam generator. The manipulator or lance guide assembly (22) is coupled to servo motors (24, 26) through the positively engaged tractor drive system. Lane to lane indexing between tubes (3) and position calibration are controlled through computer software using encoder position feedback and proximity detectors (35, 37) positioned at the ends of the lance guide (12) and Lance Guide Head (34**).

Waterlance (14) traversing is driven by a servo motor (26) through the tractor drive positively coupled to the engagement holes (16) in the waterlance body. The servo controlled motors (24), (26) allow the waterlance (14) to jet water on insertion as well as retraction in the intertube lane. Drive power is also controlled to detect obstructions in the tube lanes and prevent over stressing of the waterlance.

Figure 2:
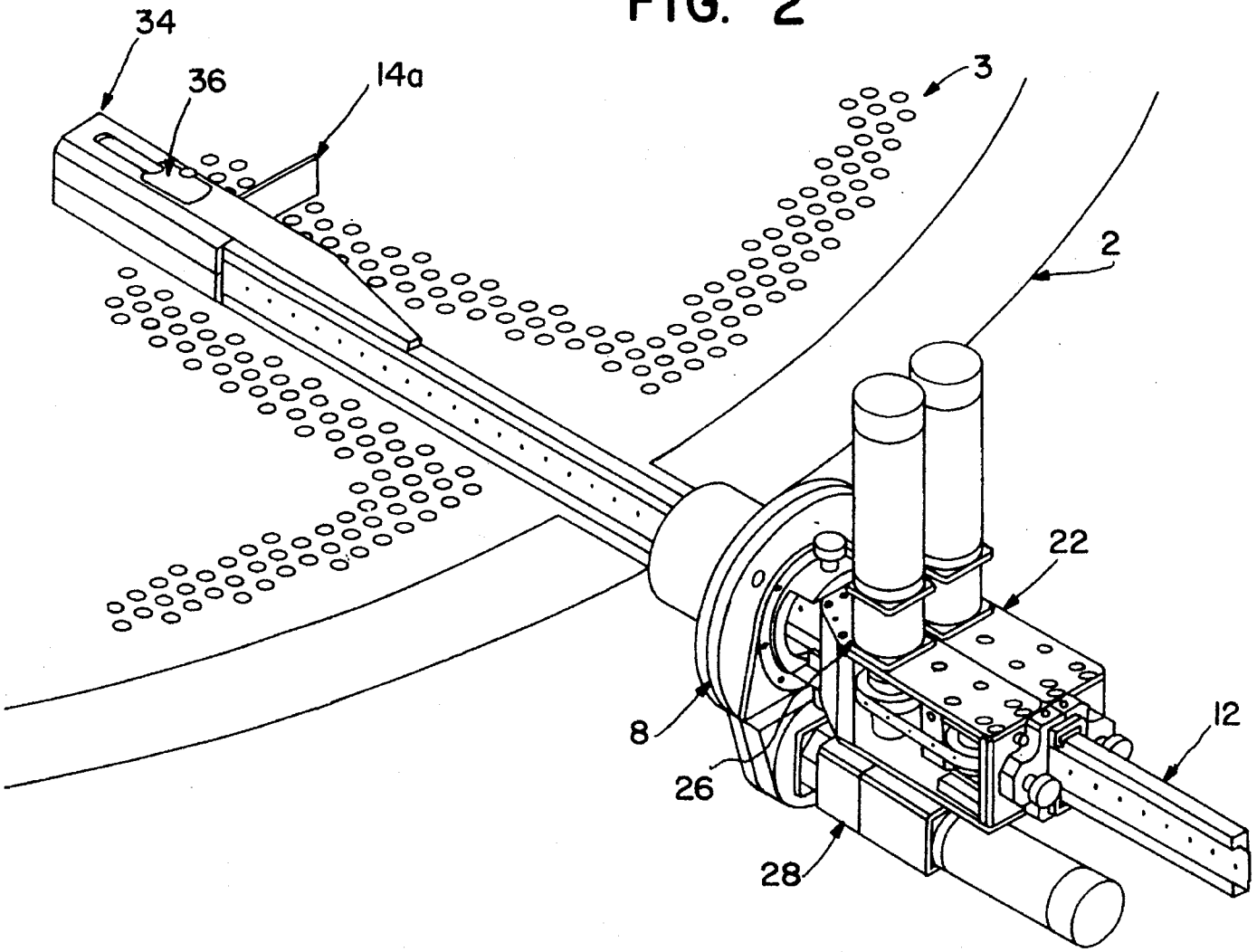
FIG. 2 is a perspective view similar to FIG. 1 of another embodiment of the present invention.
Figure 5:
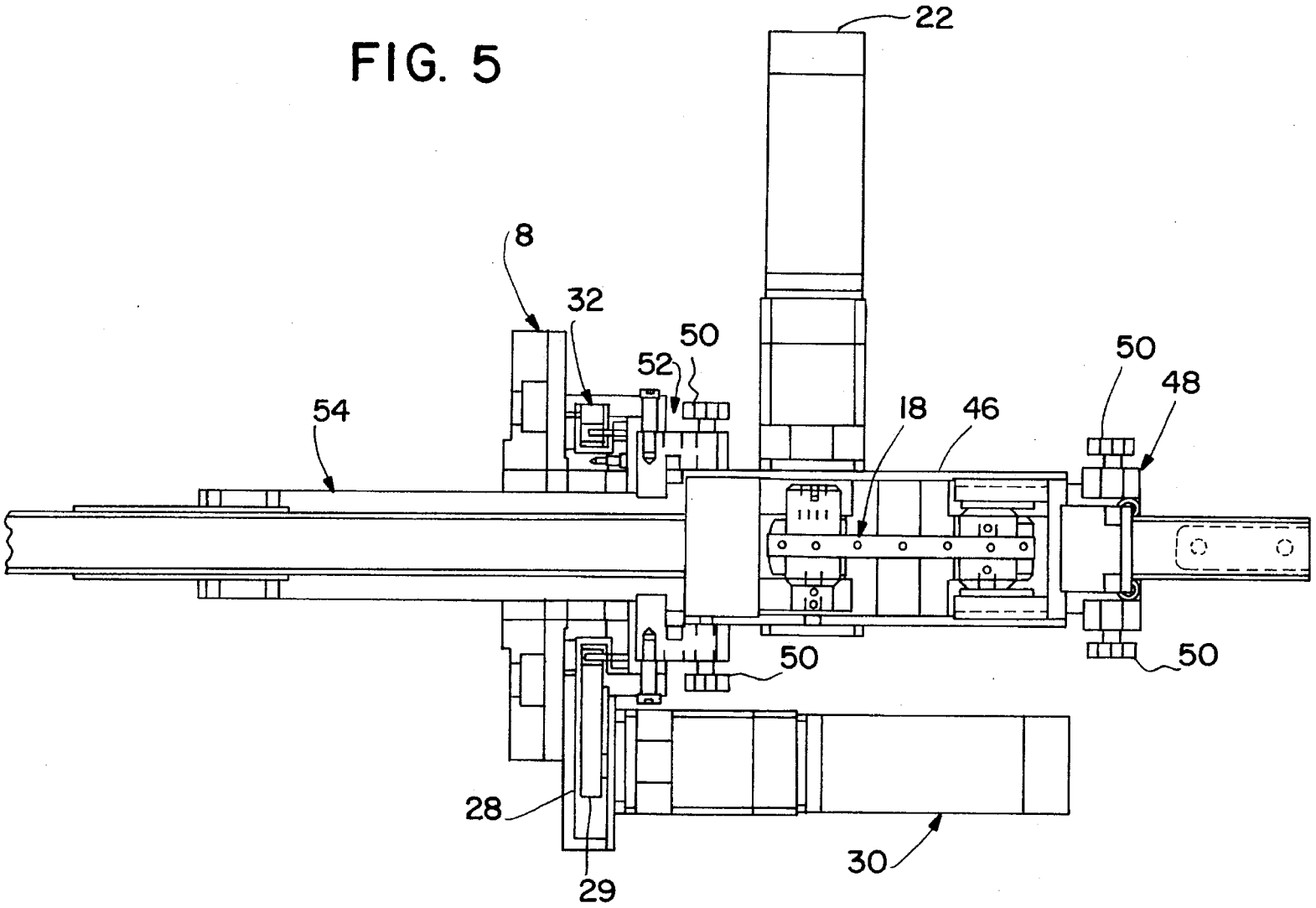
FIG. 5 is a front sectional view of a portion of the automated sludge lance according to the present invention.

Next, referring to FIG. 2, a rotational drive assembly (28) with position feedback is coupled to the no-tube-lane lance guide drive assembly (22) to drive the lance guide (12) and waterlance (14) for full rotational tube sheet to first support plate coverage or coverage between support plates. Cutting waterlances and sludge height measuring tools can also be rotated over excessively high sludge piles. The rotational drive assembly (28) provides full rotation to allow sludge removal from both halves of the steam generator. It also can provide movement to a predetermined angle. The rotational drive assembly (28) as is best seen in FIG. 5 includes a rotation drive motor (30). Rotation bearing assembly (32) facilitates movement by the rotational drive assembly (28).

The servo controlled motors (24, 26, 30) consist of digital motion control hardware and amplifiers necessary to control the lance guide (12) and waterlance (14) position. The controller has been selected to exceed the requirements of the control system to allow the addition of other options at a later date. Instructions from a computer system (not shown) are processed by the servo-controller motor and, based on encoder data, translated into control signals to the mechanical system.

Instruction to the servo-controller are generated preferably by a 80486 microcomputer station located outside of containment and continually manned during lancing operations. The microcomputer preferably uses menu-based user-friendly software able to allow single-action commands or complex multi-command sequences with relative ease. The operator designates the range or lanes to be lanced, the number of passes through a keyboard or mouse and the control system automates the entire lancing process, alerting the operator when problems such as lane blockage, high water levels, indexing trouble or pump problems are experienced. The system can also generate daily progress reports and graphical output as the software is sufficiently flexible to accommodate various access points, steam generator tube patterns, lancing strategies and reporting options.

The lance guide is a motorized tool that advance through the steam generator handhole for access along the no-tube-lane in the center of the steam generator, and along the annulus around the tube bundle of the steam generator when employing the articulated annular sludge lance as described in U.S. patent application Ser. No. 08/126,453 filed Sep. 24, 1993 which is hereby incorporated by reference. Various inspection tools can be employed through the body of the lance guide out the guide head (34) for insertion between the tubes in the steam generator tube bundle. Restricted only by tie bars within the bundle, the sludge lancing tools can generally penetrate through the entire tube bundle including the deep sludge pile region.

Of the lancing tools used, the cutting lance is the one most generally used. It incorporates two high pressure jets for cutting sludge or the tubesheet and clearing broach holes overhead in the support plates. The straight ahead water lance houses water jets facing ahead of the lance, and is used to descale tubes and remove softer sludge to allow unrestricted insertion of the cutting lance. Two other tools, the visual inspection strip and the sludge height measurement tool incorporate fiber optics and other special features to inspect conditions in the steam generator both before and after lancing. Water and entrained sludge are removed via another handhole with high capacity suction systems known in the art.

Like the lances described in U.S. Pat. Nos. 4,980,120 and 5,194,217, the sludge lance of the present invention may be made from a high impact strength plastic like polycarbonate or Acetal, and/or metals such as aluminum, stainless steel, or brass, or a combination thereof.

Figure 3:
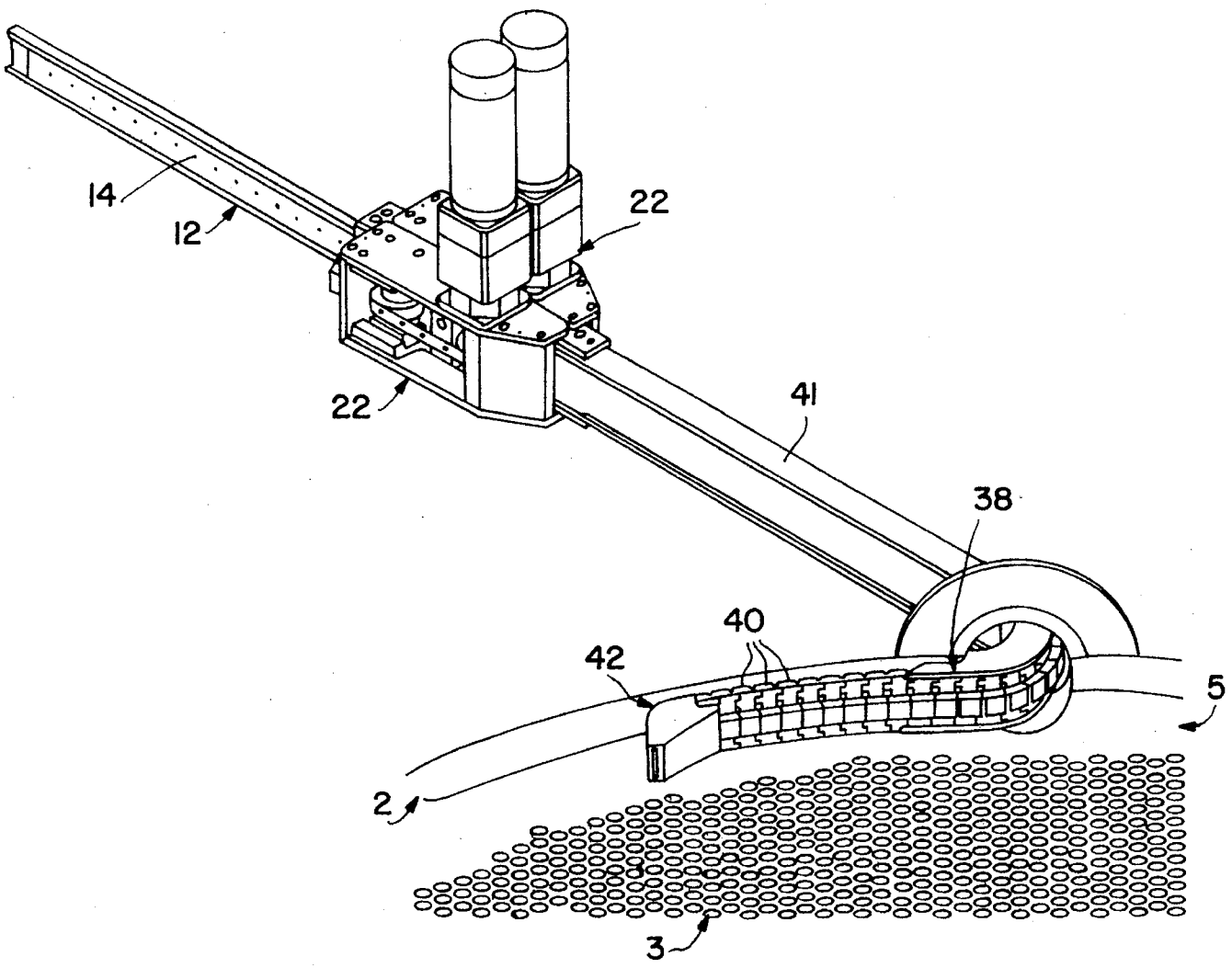
FIG. 3 is a perspective view similar to FIG. 1 and 2 showing the remote control system of the present invention automatically manipulating an annular articulated sludge lance.

In some steam generators there is a shroud or inner shell covering the tube bundle except for about an eight inch off-set from the tubesheet. As seen in FIG. 1, there is one entry into the no-tube-lane (4) from a handhole (6) with a diameter of about two and one-half inches. The other handholes in some steam generators have a diameter of about three and one-half inches. The annular chamber (5) is about three and one-half to four inches wide. Of course, other steam generators will differ dimensionally according to their specifications. CANDU steam generators have tight geometry constraints which limit water lance size to typically about 0.100, about 0.115, or about 0.125 inches thick, about 1.25 or 1.5 inches wide and about 8 to 10 feet long. Due to space constraints, the sludge lance (10) must have the ability to fit into tight places. FIG. 3 shows an articulated annular sludge lance being remotely controlled with the sludge lance drive assembly (22). The delivery rail (41) preferably provides an axis ranging from 0° to 90° to allow the track members (40) to advance into and around the annular chamber or annulus (5) of the steam generator (2). Alternate embodiments include the use of a single flexible track to accommodate the waterlance (14) or even act as the track itself still utilizing a manipulator head (42) to direct the waterlance (14) in between the tubes (3). The track would be positioned inside the annular chamber (5) of the steam generator (2).

Insertion and retraction of the waterlance (14) and lance guide are preferably through pinned metal drive belts (18) engaging in drilled holes (16) in the waterlance and lance guide for positive position control as described earlier with the no-tube-lane. As mentioned earlier, the waterlance (14) and lance guide (12) drive motors (24, 26) are mounted to a drive assembly (22) which is coupled to the rotational drive assembly (28) through a gear belt assembly (29) seen in FIG. 5.

In fabricating a steam generator, tie rods are used to retain the support plates. Normally, the tie rods are three-quarter inch steel members which after fabrication of the steam generator can block a lance from cleaning between the tubes. Because of the number of the tie rods in a steam generator, a vast area of the steam generator remains uncleaned with prior art techniques. The method and sludge lance of the present invention provide a far more effective cleaning of sludge from between the tubes (3) in steam generator (2).

Figure 4:
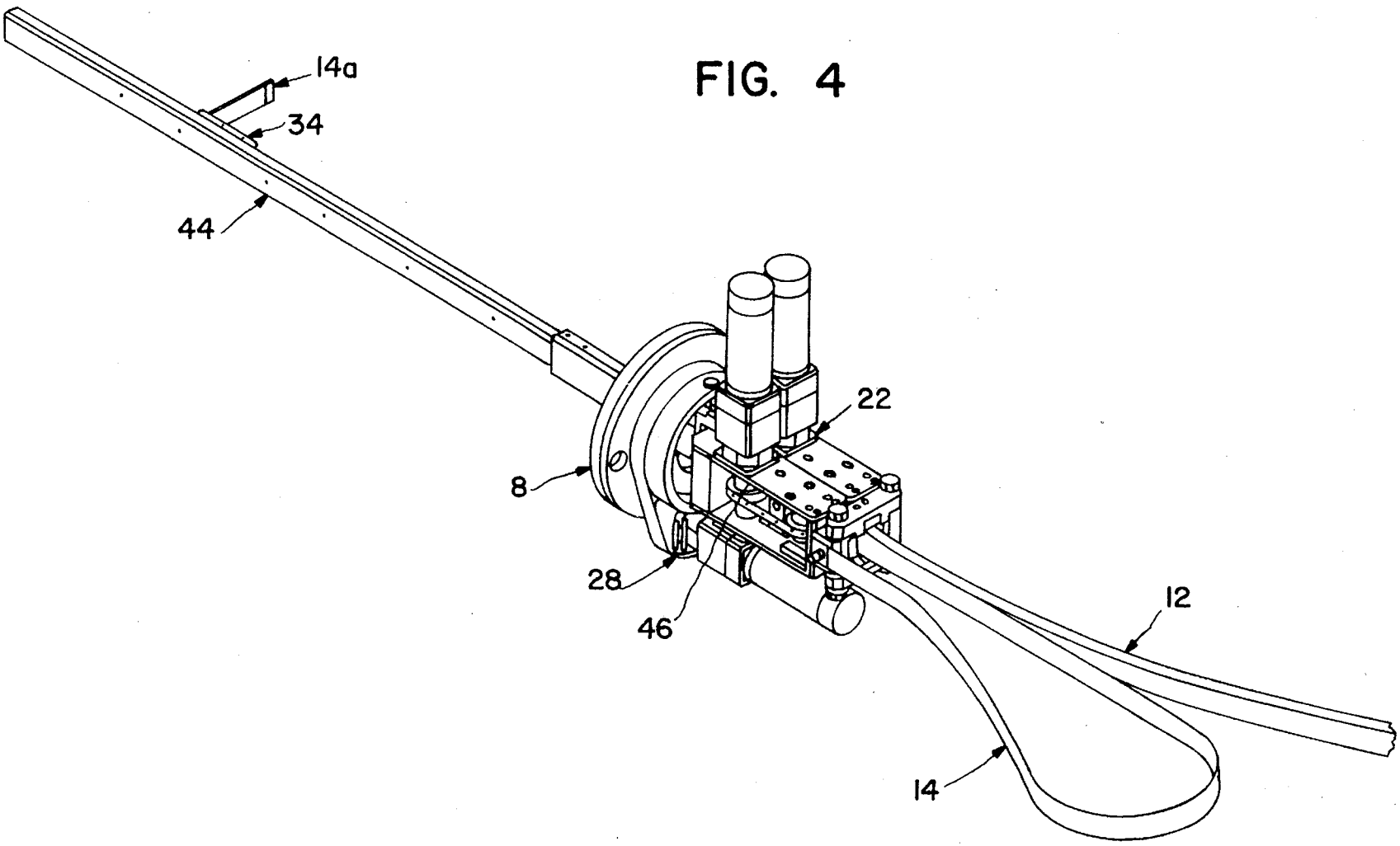
FIG. 4 is a view similar to the preceding views but without the steam generator showing the waterlance partially retracted.

FIG. 4 shows the flexible waterlance (14) in a partially retracted state. The flexible waterlance (14) bends in a loop out of the way. In this embodiment, an optional guide channel (44) provides additional support for the lange guide (12) and waterlance (14). The lance guide head (34) directs the waterlance (14) between the tubes of the steam generator at any selected location. The flexible waterlance (14) is shown forming a loop at one end as it is partially retracted.

As shown in FIG. 5, the lance guide and waterlance drive assembly (22) preferably includes two servo motors (24, 26) mounted vertically to a bracket (46). The pulleys (20) fit within bracket (46) along with metal pinned belt (18). Each servo motor has its own bracket positioned on each side of the lance guide (12) and waterlance (14) as seen in the several figures. Both brackets (46) are pivotally connected at the end adjacent the steam generator. This allows the opposite end to open up like a clam to facilitate set-up of the lance guide (12) and waterlance (14) therein. Guide roller assembly (48) assists in maintaining proper orientation. Preferably the fasteners (50) are hand adjustable to clamp the brackets (46) closed where the belt (18) engages the lance guide (12) on one side and the other belt (18) engages the waterlance (14). Similar fasteners (50) attach the drive assembly (22) to the drive mounting assembly (52). Optionally a guide support bracket (54) stabilizes the entire assembly in the steam generator.

While specific embodiments of the invention have been shown and described in detail to illustrate the application and principles of the invention, certain modifications and improvements will occur to those skilled in the art upon reading the foregoing description. It is thus understood that such modifications and improvements have been deleted herein for the sake of conciseness and readability but are properly within the scope of the following claims.

I claim:

1. A method for removing sludge located between a plurality of tubes within a steam generator, comprising the steps of:

positioning a lance guide having a waterlance movably contained therein in a handhole of the steam generator;

remotely advancing the lance guide and the waterlance with a first drive means to a selected position inside the steam generator;

then remotely inserting the waterlance between the tubes of the steam generator with a second drive means;

directing a fluid between the tubes to remove sludge therefrom; and removing sludge from between the tubes with the lance guide and waterlance situated in a no-tube-lane of the steam generator.

2. A method as recited in claim 1, wherein the advancing step includes the step of simultaneously advancing the lance guide with the waterlance.

3. A method as recited in claim 2, wherein the waterlance is first returned to a predetermined location within the lance guide prior to advancing.

4. A method as recited in claim 1, wherein the positioning step includes the step of mounting the first and second drive means to the steam generator for advancing the lance guide and waterlance, and inserting the waterlance between tubes.

5. An automated sludge lance as recited in claim 1, further comprising means for providing rotational movement to said lance guide and waterlance for removing sludge at a varying angle.

* * * * *